US012194596B2

(12) United States Patent
Mizutani et al.

(10) Patent No.: US 12,194,596 B2
(45) Date of Patent: Jan. 14, 2025

(54) TOOL WITH SINGLE SENSOR TO DETECT ATTACHMENT OF SIDE GRIP AND COVER

(71) Applicant: MAKITA CORPORATION, Anjo (JP)

(72) Inventors: Akira Mizutani, Anjo (JP); Junya Ishikawa, Anjo (JP); Daiki Imaida, Anjo (JP)

(73) Assignee: MAKITA CORPORATION, Anjo (JP)

( * ) Notice: Subject to any disclaimer, the term of this patent is extended or adjusted under 35 U.S.C. 154(b) by 337 days.

(21) Appl. No.: 17/914,949

(22) PCT Filed: Apr. 8, 2021

(86) PCT No.: PCT/JP2021/014892

§ 371 (c)(1),
(2) Date: Sep. 27, 2022

(87) PCT Pub. No.: WO2021/206139

PCT Pub. Date: Oct. 14, 2021

(65) Prior Publication Data

US 2023/0150085 A1 May 18, 2023

(30) Foreign Application Priority Data

Apr. 10, 2020 (JP) ..... 2020-071239

(51) Int. Cl.
*B24B 49/12* (2006.01)
*B24B 23/00* (2006.01)
*B24B 23/02* (2006.01)

(52) U.S. Cl.
CPC ..... *B24B 49/12* (2013.01); *B24B 23/005* (2013.01); *B24B 23/028* (2013.01)

(58) Field of Classification Search
CPC ... B24B 23/005; B24B 23/022; B24B 23/028; B24B 55/05; B24B 55/052;
(Continued)

(56) References Cited

U.S. PATENT DOCUMENTS

2003/0202851 A1* 10/2003 Kovarik ..... B25F 5/021 408/8
2018/0272494 A1* 9/2018 Schadow ..... B25F 5/026
(Continued)

FOREIGN PATENT DOCUMENTS

WO 2017/051893 A1 3/2017
WO 2018/180083 A1 10/2018

OTHER PUBLICATIONS

Jun. 8, 2021 International Search Report issued in International Patent Application No. PCT/JP2021/014892.
(Continued)

*Primary Examiner* — C. A. Rivera
(74) *Attorney, Agent, or Firm* — Oliff PLC

(57) ABSTRACT

A tool includes a first accessory, a second accessory, a first attachment portion configured to allow the first accessory to be detachably attached thereto, a second attachment portion configured to allow the second accessory to be detachably attached thereto, a first intermediate member configured to be displaced from a first non-attachment position to a first attachment position by the attachment of the first accessory to the first attachment portion, a second intermediate member configured to be displaced from a second non-attachment position to a second attachment position by the attachment of the second accessory to the second attachment portion, and a single sensor configured to detect a specific state in which the first intermediate member is located at the first attachment position and the second intermediate member is located at the second attachment position.

19 Claims, 16 Drawing Sheets

(58) Field of Classification Search
CPC ..... B24B 49/003; B24B 49/12; B25F 5/00; B25F 5/02; B25F 5/026; B25G 1/00; B25G 3/00
See application file for complete search history.

(56) References Cited

U.S. PATENT DOCUMENTS

| | | | | |
|---|---|---|---|---|
| 2018/0281146 | A1 | 10/2018 | Tomonaga et al. | |
| 2020/0055159 | A1* | 2/2020 | Sakai | B24B 47/12 |
| 2023/0023204 | A1* | 1/2023 | Otani | B25F 5/02 |
| 2023/0119351 | A1* | 4/2023 | Sugiura | B25F 5/026 451/359 |

OTHER PUBLICATIONS

Oct. 6, 2022 International Preliminary Report on Patentability issued in International Patent Application No. PCT/JP2021/014892.

* cited by examiner

TOOL WITH SINGLE SENSOR TO DETECT ATTACHMENT OF SIDE GRIP AND COVER

TECHNICAL FIELD

The present invention relates to a tool configured to allow two types of accessories to be detachably attached thereto.

BACKGROUND

Various kinds of accessories may be detachably attached to a tool including a prime mover. For example, in the case of a grinder including a tool accessory configured to be rotationally driven, examples of detachably attachable accessories prepared therefor include a cover for covering a part of the tool accessory (also referred to as a wheel cover, a disk cover, a blade case, or the like), and a side handle to be held by the other hand of a user when the user holds a handle of the grinder with one of his/her hands.

For such a grinder, there is a demand for preventing the grinder from being used in a state that the accessory is not attached. For example, the following patent literature, PTL 1 discloses a grinder including a sensor that detects whether or not a cover is attached and a controller that prohibits a rotation of a tool accessory when the cover is not attached. Further, the following patent literature, PTL 2 discloses a grinder including a sensor that detects whether or not a cover is attached and a sensor that detects whether or not a side handle is attached.

CITATION LIST

[PTL 1] International Publication No. 2017-051893
[PTL 2] US Patent Application Publication No. 2018/272494

SUMMARY

Technical Problem

However, according to the technique discussed in PTL 2, the configuration that prohibits the rotation of the tool accessory unless both the cover and the side handle are attached raises the necessity of providing an individual sensor for each of the cover and the side handle, thereby leading to a cost increase. Such problems are not limited to the grinder, and lie in common for any tool configured to allow two types of accessories to be detachably attached thereto. Under these circumstances, it is desired to allow the tool to be able to detect that the two types of accessories are attached using one sensor.

Solution to Problem

The present specification discloses a tool. This tool may include a first accessory, a second accessory, a first attachment portion configured to allow the first accessory to be detachably attached thereto, a second attachment portion configured to allow the second accessory to be detachably attached thereto, a first intermediate member configured to be displaced from a first non-attachment position to a first attachment position by the attachment of the first accessory to the first attachment portion, a second intermediate member configured to be displaced from a second non-attachment position to a second attachment position by the attachment of the second accessory to the second attachment portion, and a single sensor configured to detect a specific state in which the first intermediate member is located at the first attachment position and the second intermediate member is located at the second attachment position.

According to this tool, the tool detects that the first intermediate member is located at the first attachment position and the second intermediate member is located at the second attachment position using the single sensor. The first intermediate member located at the first attachment position means that the first accessory is attached, and the second intermediate member located at the second attachment position means that the second accessory is attached, and therefore the attachment of the two types of accessories can be detected using the single sensor.

DESCRIPTION OF EMBODIMENTS

Figure 1:
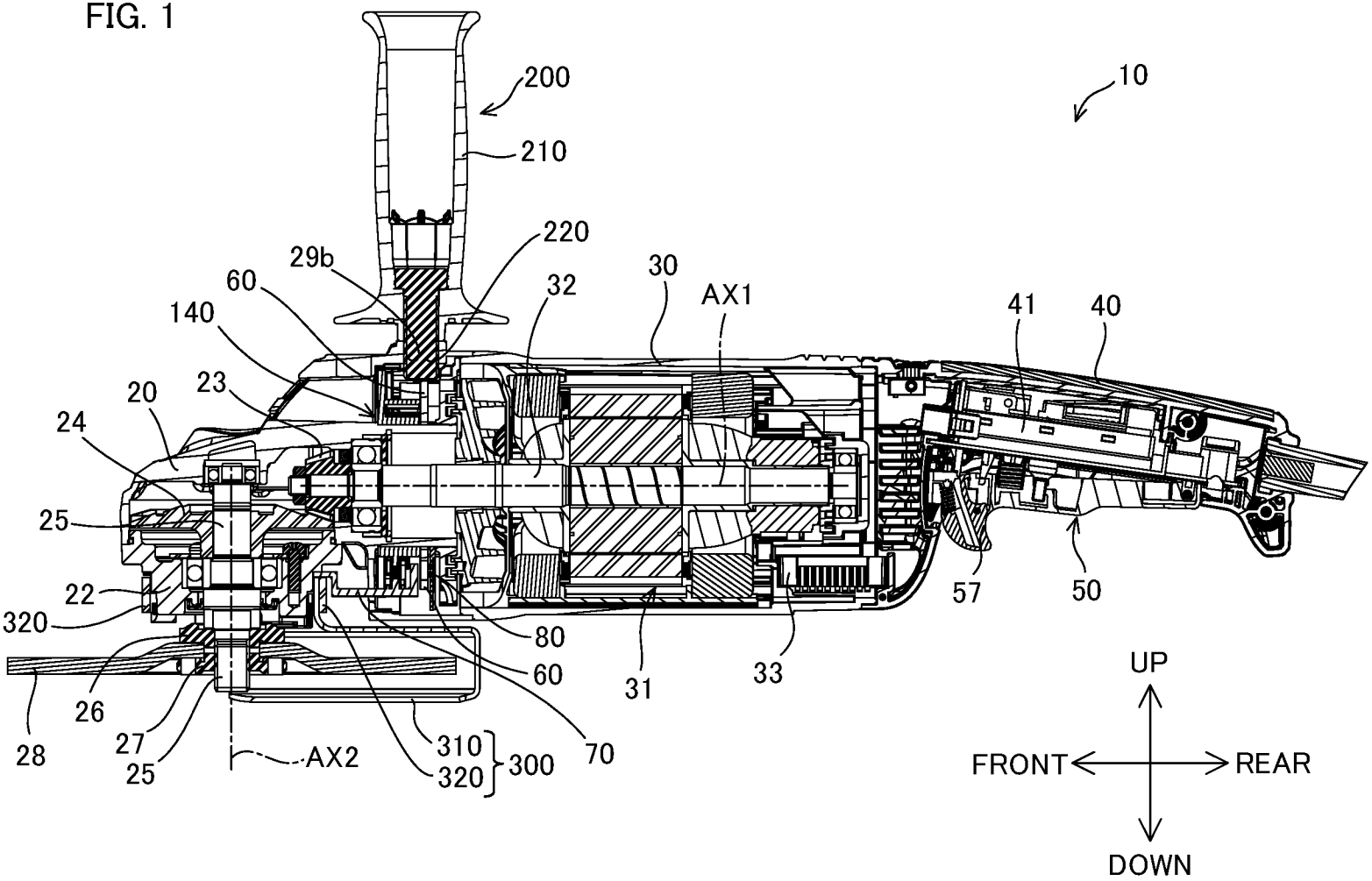
FIG. 1 is a vertical cross-sectional view of a grinder according to a first embodiment of the present invention, and illustrates a state in which a side grip and a wheel cover are attached thereto.

In one or more embodiment(s), a tool may include a first accessory, a second accessory, a first attachment portion configured to allow the first accessory to be detachably attached thereto, a second attachment portion configured to allow the second accessory to be detachably attached thereto, a first intermediate member configured to be displaced from a first non-attachment position to a first attachment position by the attachment of the first accessory to the first attachment portion, a second intermediate member configured to be displaced from a second non-attachment position to a second attachment position by the attachment of the second accessory to the second attachment portion, and a single sensor configured to detect a specific state in which the first intermediate member is located at the first attachment position and the second intermediate member is located at the second attachment position.

According to this tool, the tool detects that the first intermediate member is located at the first attachment position and the second intermediate member is located at the second attachment position using the single sensor. The first intermediate member located at the first attachment position means that the first accessory is attached, and the second intermediate member located at the second attachment position means that the second accessory is attached, and therefore the attachment of the two types of accessories can be detected using the single sensor.

In one or more embodiment(s), the single sensor may be a photoelectric sensor including a light emitter and a light receiver, or an ultrasonic sensor. The first intermediate member may be configured to be displaced between a position of blocking light emitted from the light emitter or an ultrasonic wave emitted from the ultrasonic sensor and a position of not blocking the light or the ultrasonic wave due to the attachment or no attachment of the first accessory to the first attachment portion. The second intermediate member may be configured to be displaced between a position of blocking the light or the ultrasonic wave and a position of not blocking the light or the ultrasonic wave due to the attachment or no attachment of the second accessory to the second attachment portion. According to this configuration, the attachment of the two types of accessories can be easily detected using the single photoelectric sensor or the single ultrasonic sensor.

In one or more embodiment(s), the single sensor may be a reflection-type photosensor. In one or more embodiment(s), the single sensor may be a transmission-type photosensor.

In one or more embodiment(s), the tool may include an electric motor, and a controller configured to control driving of the electric motor. The controller may permit the electric motor to be driven when the single sensor detects the specific state and prohibit the electric motor from being driven when the single sensor does not detect the specific state.

In one or more embodiment(s), the tool may be a grinder including a tool accessory configured to be rotated by the electric motor. The first accessory may be a side grip, and the second accessory may be a cover that partially covers the tool accessory.

In one or more embodiment(s), the first attachment portion may include at least two side grip attachment portions for selectively attaching the side grip. The first intermediate member may be a single member provided in common for the at least two side grip attachment portions and configured to be rotatable about a rotational axis of the electric motor. The at least two side grip attachment portions may be located at positions spaced apart from each other in a circumferential direction around the rotational axis, respectively. The first intermediate member may include at least one pressed portion configured to, when the side grip is attached to one side grip attachment portion arbitrarily selected from the at least two side grip attachment portions, be directly or indirectly pressed by the side grip, and the first intermediate member may be rotated about the rotational axis when the at least one pressed portion is pressed. According to this configuration, regardless of which is selected from the at least two side grip attachment portions to attach the side grip, this attachment can be detected. In addition, the single first intermediate member is used in common for the at least two side grip attachment portions, and therefore the number of components can be reduced.

In one or more embodiment(s), the first intermediate member may have an annular shape or a partially annular shape. According to this configuration, the first intermediate member is shaped to correspond to the layout of the at least two side grip attachment portions, and therefore the single first intermediate member can be used in common for the at least two side grip attachment portions with a simple structure.

In one or more embodiment(s), the at least one pressed portion may protrude radially outward from a first intermediate member main body. The at least one pressed portion may be provided at at least two positions respectively corresponding to positions of the at least two side grip attachment portions, respectively. According to this configuration, the first intermediate member can be easily rotated.

In one or more embodiment(s), the at least one pressed portion may include a pressed surface angled with respect to a longitudinal direction of the side grip in such a manner that the first intermediate member is displaced in a direction different from the longitudinal direction of the side grip. The longitudinal direction of the side grip is a longitudinal direction of the side grip when the side grip is attached to the one side grip attachment portion. According to this configuration, the first intermediate member can be easily rotated.

In one or more embodiment(s), the first intermediate member main body may include a first through-hole having a circular-arc shape centered at the rotational axis. The first intermediate member main body may be attached rotatably along the circular-arc shape using a screw via the first through-hole. According to this configuration, the first intermediate member can be held rotatably with a simple structure.

In one or more embodiment(s), the first intermediate member may include a second through-hole. The light or the ultrasonic wave may pass through the second through-hole when the first intermediate member is located at the position of not blocking the light or the ultrasonic wave. According to this configuration, the first intermediate member can have a compact size.

In one or more embodiment(s), the second intermediate member may be configured to be linearly moved by being directly or indirectly pressed by the cover when the cover is attached to the second attachment portion. According to this configuration, the tool does not have to include a direction conversion mechanism by being designed in such a manner that the attachment direction of the cover matches a linear motion direction of the second intermediate member, thereby allowing the second intermediate member to be displaced with a simple structure.

In one or more embodiment(s), the second intermediate member may include a third through-hole in the form of an elongated hole having a longitudinal direction extending along a direction in which the second intermediate member is linearly moved. The second intermediate member may be attached linearly movably along the elongated hole using a screw via the third through-hole. According to this configuration, the second intermediate member can be held linearly movably with a simple structure.

In one or more embodiment(s), the tool may include a single holding member that holds the first intermediate member and the second intermediate member. According to this configuration, mounting each of the first intermediate member and the second intermediate member on the holding member automatically determines the relative positions of the first intermediate member and the second intermediate member. In other words, the relative positions of the first intermediate member and the second intermediate member do not have to be adjusted when the tool is assembled.

In the following description, the embodiments of the present invention will be described in further detail with reference to the drawings. First, a first embodiment of the present invention will be described with reference to FIGS. 1 to 14. In the embodiments that will be described below, a handheld-type electric disk grinder (hereinafter simply referred to as a grinder) 10 will be cited as an example of the tool.

Figure 2:
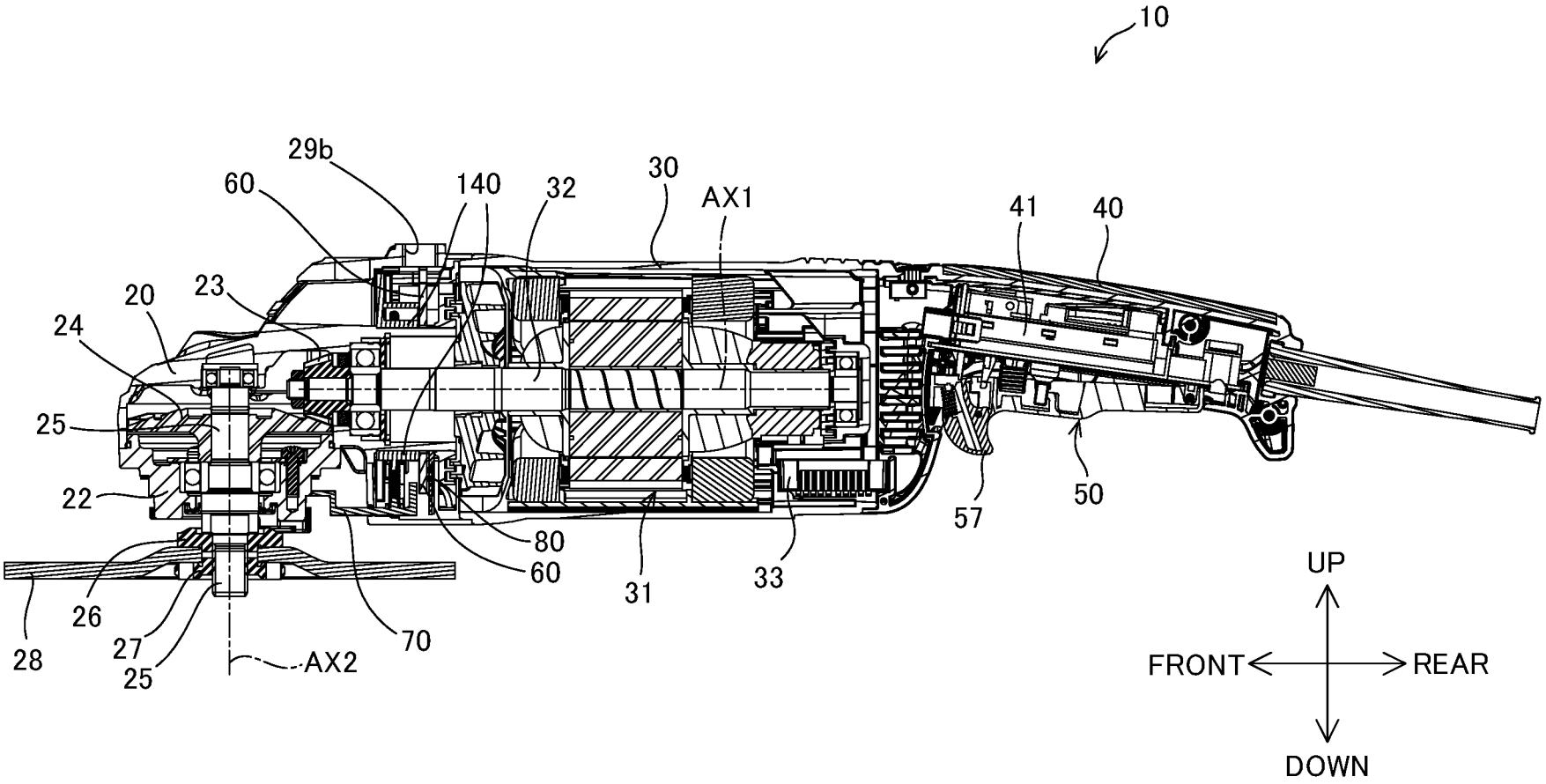
FIG. 2 is a vertical cross-sectional view of the grinder, and illustrates a state in which the side grip and the wheel cover are detached therefrom.

As illustrated in FIGS. 1 and 2, the grinder 10 is configured to rotationally drive a generally disk-like tool accessory 28 mounted around a spindle 25. The spindle 25 is rotated by a rotational driving force provided from an electric motor 31 as the prime mover. A grinding stone, a rubber pad, a brush, a blade, and the like are prepared as the tool accessory 28 mountable on the grinder 10. A user selects the appropriate tool accessory 28 according to desired processing work and mounts it on the grinder 10. According to the grinder 10, processing work such as grinding, polishing, and cutting can be performed on a processing target material according to the type of the tool accessory 28.

In the following description, a direction in which a rotational axis AX1 of the electric motor 31 (i.e., a motor shaft 32) extends is defined to be a front-rear direction of the grinder 10. One side in the front-rear direction on which the tool accessory 28 is located is defined to be a front side, and the opposite side therefrom is defined to be a rear side. Further, a direction in which a rotational axis AX2 of the spindle 25 (i.e., a rotational axis of the tool accessory 28) extends is defined to be a vertical direction of the grinder 10. One side in the vertical direction on which the tool accessory 28 is located is defined to be a lower side, and the opposite side therefrom is defined to be an upper side. Further, a direction perpendicular to the vertical direction and the front-rear direction is defined to be a left-right direction of the grinder 10. A right side in the left-right direction when the front side is viewed from the rear side is defined to be a right side of the grinder 10, and the opposite side therefrom is defined to be a left side of the grinder 10.

As illustrated in FIGS. 1 and 2, the grinder 10 includes a gear housing 20, a motor housing 30, and a handle housing 40. The electric motor 31 is contained in the motor housing 30, which is located between the gear housing 20 and the handle housing 40 in the front-rear direction, i.e., the longitudinal direction of the grinder 10. The electric motor 31 is configured to be driven by electric power supplied from outside (alternating-current power supplied from an AC power source in the present embodiment, but may be direct-current power supplied from a battery). Further, a controller 33 is contained between the electric motor 31 and a switch 41 in the front-rear direction in the handle housing 40. The controller 33 receives the electric power supplied from outside and supplies this electric power to the electric motor 31 and a sensor 80, which will be described below. The controller 33 controls the driving of the electric motor 31 by controlling the electric power supplied to the electric motor 31.

A mechanism for transmitting the rotational driving force of the electric motor 31 to the tool accessory 28 is contained in the gear housing 20. More specifically, a small bevel gear 23, a large bevel gear 24, and the spindle 25 are contained in the gear housing 20. The small bevel gear 23 is fixed around the motor shaft 32 at the front end portion of the motor shaft 32 of the electric motor 31. The spindle 25 is supported rotatably about the rotational axis AX2 by bearings disposed so as to be vertically spaced apart from each other. The rotational axis AX2 intersects with (more specifically, intersects perpendicularly to) the rotational axis AX1 of the electric motor 31. The large bevel gear 24 is fixed around the spindle 25 on the upper side of the spindle 25, and is meshed with the small bevel gear 23. The gear housing 20 includes a second attachment portion 22 at the lower edge portion thereof. The second attachment portion 22 is used to detachably attach a cover 300. The second attachment portion 22 has a vertically extending cylindrical shape. The spindle 25 extends vertically in the gear housing 20, and extends out of the gear housing 20 (more specifically, the second attachment portion 22) on the lower side.

An inner flange 26 is attached around the spindle 25 at the lower end portion of the spindle 25 extending out of the gear housing 20. A male screw portion is formed on a lower portion of the spindle 25 with respect to the inner flange 26, and a lock nut 27 is attached to this male screw portion. The position of the tool accessory 28 relative to the spindle 25 is fixed by interposing the tool accessory 28 between the inner flange 26 and the lock nut 27 and tightening the lock nut 27.

The handle housing 40 is a portion to be held by the user with one of his/her hands when the grinder 10 is in use. The handle housing 40 has a hollow circular cylindrical shape extending generally in the front-rear direction. The switch 41 for driving the electric motor 31 is contained inside the handle housing 40. An operation member 50 is provided under the handle housing 40. The operation member 50 is configured to be displaceable between an OFF position of bringing the switch 41 into an OFF state and an ON position of bringing the switch 41 into an ON state. FIGS. 1 and 2 illustrate the operation member 50 located at the OFF position. A lock-off switch 57 is provided near the front end of the operation member 50 in the front-rear direction. The lock-off switch 57 is used to engage the operation member 50 at the OFF position, thereby prohibiting the operation member 50 from being displaced to the ON position. When the operation member 50 is operated from the OFF position to the ON position by the user, the switch 41 detects that and transmits a detection signal to the controller 33. Upon receiving this detection signal, the controller 33 supplies the electric power to the electric motor 31, thereby driving the electric motor 31. When the electric motor 31 is driven, the rotation of the motor shaft 32 is transmitted to the spindle 25 while being slowed down via the small bevel gear 23 and the large bevel bear 24. At this time, the direction of the rotational motion is converted from the direction around the motor shaft 32 into the direction around the rotational axis AX2 of the spindle 25. According to this mechanism, the spindle 25 is rotated about the rotational axis AX2 in response to the rotation of the motor shaft 32, and the tool accessory 28 fixed by the inner flange 26 and the lock nut 27 is rotated together with the spindle 25 as a result thereof.

As illustrated in FIG. 1, the grinder 10 further includes a side handle 200 and the cover 300 as the accessories thereof. The side handle 200 is prepared to be held by the user with the opposite hand from his/her hand holding the handle housing 40. The user can further stably hold the grinder 10 by using the side handle 200. The side handle 200 includes a grip portion 210 to be held by the user, and an attachment portion 220 to be attached to the gear housing 20. The attachment portion 220 has a circular columnar shape extending in the longitudinal direction of the side handle 200, and extends out of one end of the grip portion 210 in the longitudinal direction of the side handle 200. A male screw is formed on the outer peripheral surface of the attachment portion 220.

Figure 9:
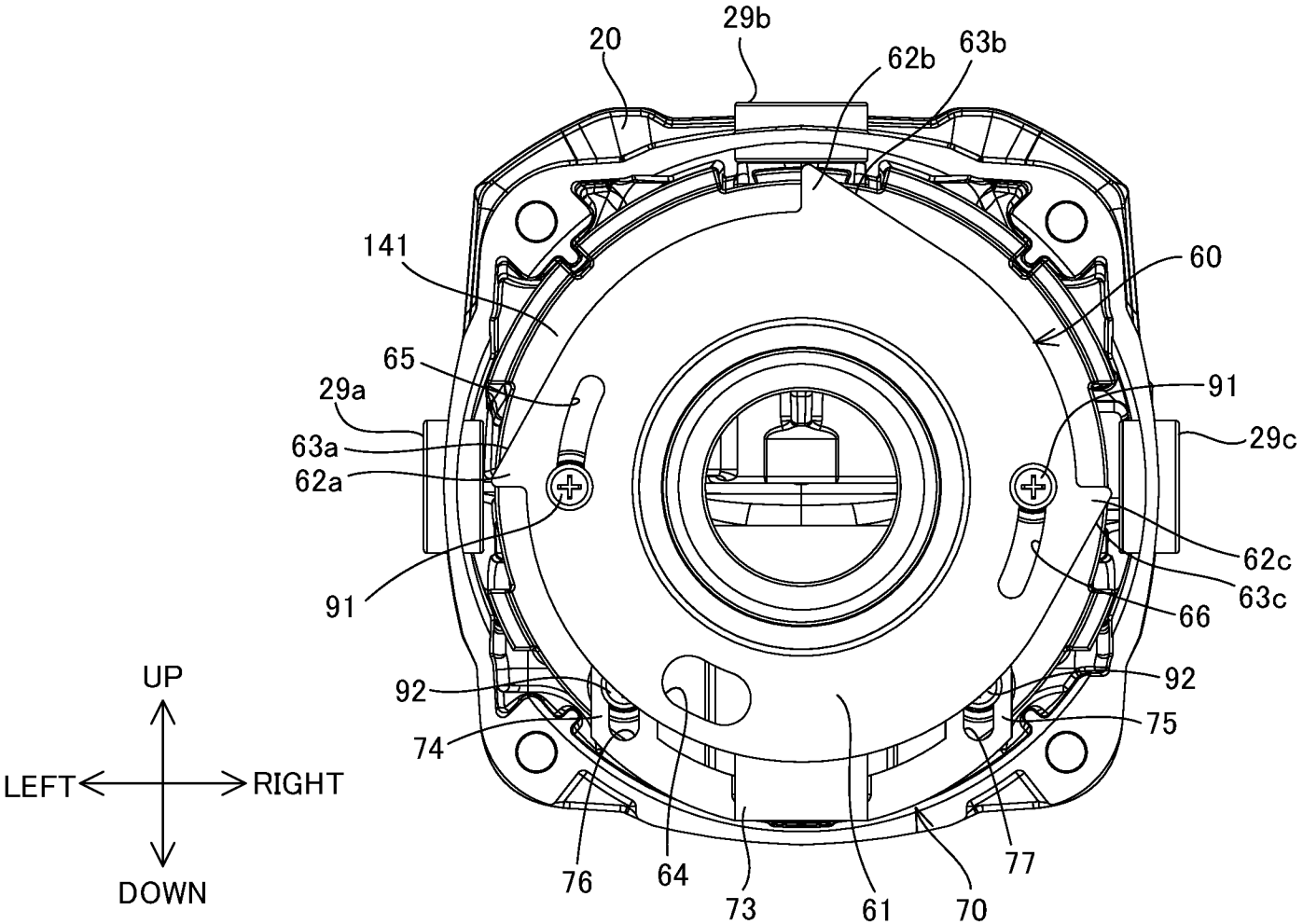
FIG. 9 illustrates the internal structure of the grinder and illustrates the state in which the side grip and the wheel cover are detached therefrom.

As illustrated in FIG. 9, the gear housing 20 includes three first attachment portions 29*a* to 29*c* for detachably attaching the side handle 200. The first attachment portions 29*a* to 29*c* are disposed at positions spaced apart from each other in the circumferential direction around the rotational axis AX1. More specifically, the first attachment portion 29*a* is formed on the left surface of the gear housing 20, the first attachment portion 29*b* is formed on the upper surface of the gear housing 20, and the first attachment portion 29*c* is formed on the right surface of the gear housing 20. The three first attachment portions 29*a* to 29*c* are provided at positions rotational symmetric with respect to the rotational axis AX1, respectively. Each of the first attachment portions 29*a* to 29*c* is provided in the form of a through-hole that establishes communication between the inside and the outside of the gear housing 20. A female screw threadedly engageable with the male screw of the attachment portion 220 is formed on the inner surface forming this through-hole.

The side handle 200 can be attached to the gear housing 20 by screwing the attachment portion 220 of the side handle 200 into selected one from the three first attachment portions 29*a* to 29*c*. The user can arbitrarily select the attachment portion of the side handle 200 from the first attachment portions 29*a* to 29*c* according to the type of the work intended to perform using the grinder 10 or according to whether the user is right-handed or left-handed. The three first attachment portions 29*a* to 29*c* are provided in the present embodiment, but the number of first attachment portions is not especially limited and may be any number equal to or greater than 1. For example, the grinder 10 may include only two first attachment portions 29*a* and 29*c*.

As illustrated in FIG. 1, the cover 300 includes a cover main body 310 to cover a part of the tool accessory 28 therewith, and an attachment portion 320 to be attached to the second attachment portion 22. The cover main body 310 covers an approximately rear half portion of the tool accessory 28. The cover main body 310 covers the upper surface, the lower surface, and the circumferential surface between the upper surface and the lower surface of the tool accessory 28 in the present embodiment, but may cover only the upper surface and the circumferential surface depending on the type of the tool accessory 28 in use. The attachment portion 320 has a generally annular shape with an opening, and extends upward from the upper surface of the cover main body 310. The attachment portion 320 includes opposing two flanges at two distal ends in the circumferential direction, although they are not illustrated because the structure of the attachment portion 320 is well known. A bolt is inserted into a screw hole formed at each of the flanges and is tightened in a state that the attachment portion 320 is disposed so as to surround the second attachment portion 22 of the gear housing 20, by which the radius of the annular shape of the attachment portion 320 reduces and the attachment portion 320 is fixed to the second attachment portion 22.

The above-described grinder 10 is configured to permit the electric motor 31 to be driven only in a state that the side handle 200 is attached to any of the first attachment portions 29*a* to 29*c* of the gear housing 20 and the cover 300 is also attached to the second attachment portion 22 of the gear housing 20. In a state that at least one of the side handle 200 and the cover 300 is not attached, the controller 33 prohibits the electric motor 31 from being driven even when the user operates the operation member 50 to the ON position and the detection signal is transmitted from the switch 41 to the controller 33. The state in which both the side handle 200 and the cover 300 are attached is detected by the single sensor 80, which will be described below, and is output from the sensor 80 to the controller 33 via a signal line (not illustrated). In the following description, a configuration for this detection will be described in detail with reference to the drawings.

As illustrated in FIGS. 1 and 2, the grinder 10 further includes a first intermediate member 60, a second intermediate member 70, a holding member 140, and the sensor 80. First, the first intermediate member 60, the second intermediate member 70, the holding member 140, and the sensor 80 will be described in outline.

The first intermediate member 60 is configured to be pressed and displaced by the attachment portion 220 of the side handle 200 by the attachment of the side handle 200 to any of the first attachment portions 29*a* to 29*c*. The first intermediate member 60 is rotated by a predetermined angle about the rotational axis AX1 as such a displacement operation in the present embodiment. The position of the first intermediate member 60 when the side handle 200 is attached to none of the first attachment portions 29*a* to 29*c* of the gear housing 20 will be referred to as a first non-attachment position (refer to FIGS. 4 and 9). The position of the first intermediate member 60 when the side handle 200 is attached to any of the first attachment portions 29*a* to 29*c* will be referred to as a first attachment position (refer to FIGS. 3, 10, and 11). The first intermediate member 60 is a generally annular member, and is disposed inside the gear housing 20 so as to surround the motor shaft 32 on the front side with respect to the electric motor 31.

The second intermediate member 70 is configured to be pressed and displaced by the attachment portion 320 of the cover 300 by the attachment of the cover 300 to the second attachment portion 22. The second intermediate member 70 is linearly moved upward as such a displacement operation in the present embodiment. The position of the second intermediate member 70 when the cover 300 is not attached to the second attachment portion 22 of the gear housing 20 will be referred to as a second non-attachment position (refer to FIGS. 4, 9, and 10). The position of the second intermediate member 70 when the cover 300 is attached to the second attachment portion 22 will be referred to as a second attachment position (refer to FIGS. 5 and 16). The second intermediate member 70 is disposed between the motor shaft 32 and the tool accessory 28 on the front side with respect to the first intermediate member 60.

The holding member 140 is disposed on the front side with respect to the first intermediate member 60, and holds the first intermediate member 60 and the second intermediate member 70 together.

The sensor 80 detects a state in which the first intermediate member 60 is located at the first attachment position and the second intermediate member 70 is located at the second attachment position. In the present embodiment, the sensor 80 is a photoelectric sensor.

Figure 5:
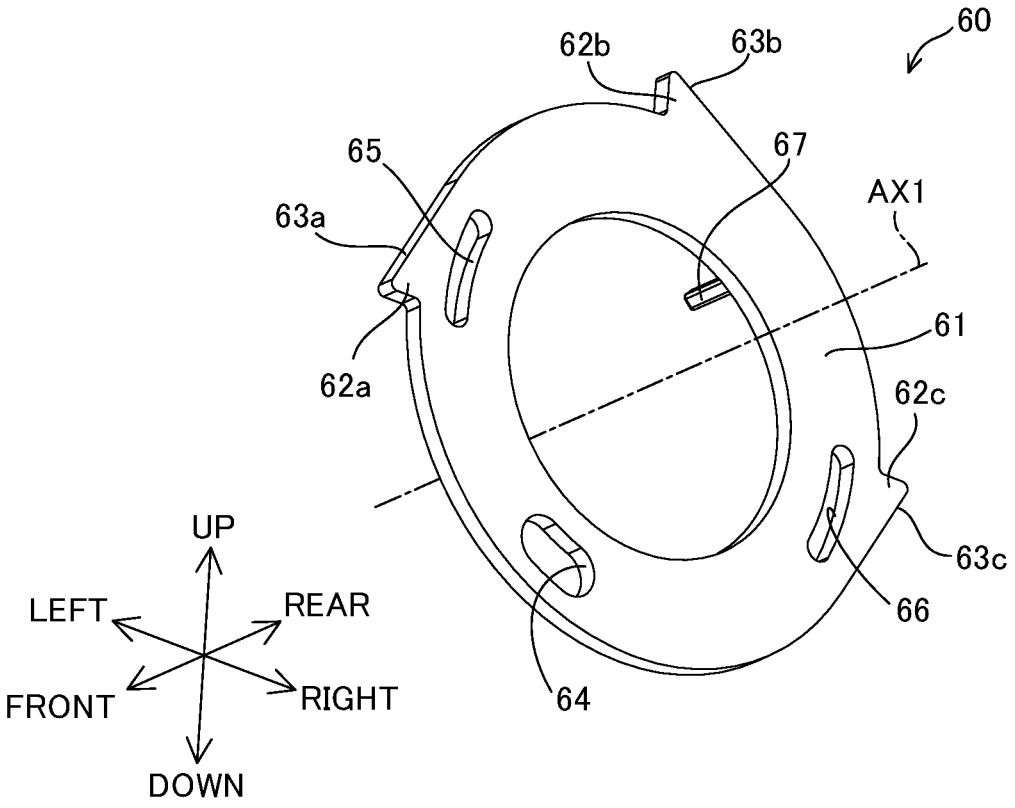
FIG. 5 is a perspective view of a first intermediate member.

In the following description, the first intermediate member 60, the second intermediate member 70, the holding member 140, and the sensor 80 will be described in detail. First, the first intermediate member 60 will be described. As illustrated in FIG. 5, the first intermediate member 60 is a single member, and is provided in common for the first attachment portions 29*a* to 29*c*. The first intermediate member 60 includes a first intermediate member main body 61. The first intermediate member main body 61 has an annular shape centered at the rotational axis AX1 of the electric motor 31 in the present embodiment. However, the first intermediate member 60 may have a partially annular shape (i.e., an unclosed annular shape). A through-hole is formed at the central portion of the first intermediate member main body 61. The motor shaft 32 extends through this through-hole.

The first intermediate member 60 further includes three pressed portions 62*a* to 62*c* and a second through-hole 64. The three pressed portions 62*a* to 62*c* are disposed so as to be circumferentially spaced apart from each other. The pressed portion 62*a* is a portion pressed by the side handle 200 (more specifically, the distal end of the attachment portion 220) when the side handle 200 is attached to the first attachment portion 29*a* of the gear housing 20. Similarly, the pressed portion 62*b* is a portion pressed by the side handle 200 when the side handle 200 is attached to the first attachment portion 29*b*, and the pressed portion 62*c* is a portion pressed by the side handle 200 when the side handle 200 is attached to the first attachment portion 29*c*. Therefore, the pressed portions 62*a* to 62*c* are disposed at angular positions corresponding to the angular positions of the first attachment portions 29*a* to 29*c*, respectively (refer to FIG. 14). Each of the pressed portions 62*a* to 62*c* protrudes radially outward from the first intermediate member main body 61.

As described above, the first intermediate member 60 is configured to be rotated about the rotational axis AX1 when any of the pressed portions 62*a* to 62*c* is pressed by the side handle 200. A comparison between FIG. 9 and FIG. 10 makes it understandable that, due to the attachment of the side handle 200 to the first attachment portion 29*c*, the pressed portion 62*c* is pressed by the side handle 200, and the first intermediate member 60 is rotated in the counter-clockwise direction from the position illustrated in FIG. 9 to the position illustrated in FIG. 10.

As illustrated in FIGS. 5 and 9, the pressed portion 62*a* includes a pressed surface 63*a* angled with respect to the longitudinal direction of the side handle 200 when the side handle 200 is attached to the first attachment portion 29*a* (i.e., the attachment direction of the side handle 200). Similarly, the pressed portion 62*b* includes a pressed surface 63*b* angled with respect to the longitudinal direction of the side handle 200 when the side handle 200 is attached to the first attachment portion 29*b*. Similarly, the pressed portion 62*c* includes a pressed surface 63*c* angled with respect to the longitudinal direction of the side handle 200 when the side handle 200 is attached to the first attachment portion 29*c*. The pressed surfaces 63*a* to 63*c* are angled at approximately 45 degrees with respect to the corresponding longitudinal direction of the side handle 200 (refer to FIG. 9). This angle can be set to any angle so as to allow the first intermediate member 60 to be displaced in a direction different from the longitudinal direction of the side handle 200. In an alternative embodiment, this angle may be set within a range of 30 degrees or larger and 60 degrees or smaller. According to the pressed surfaces 63*a* to 63*c* angled in this manner, the first intermediate member 60 can be easily rotated.

The second through-hole 64 extends through the first intermediate member 60 in the front-rear direction. When the first intermediate member 60 is located at the first non-attachment position illustrated in FIG. 9, the second through-hole 64 is located at an angular position offset from the lowermost portion of the first intermediate member 60 slightly to the left side and the upper side (i.e., a position at which the second through-hole 64 does not overlap a blocking portion 73 of the second intermediate member 70, which will be described below, as viewed in the front-rear direction). On the other hand, when the first intermediate member 60 is located at the first attachment position illustrated in FIG. 10, the second through-hole 64 is located at an angular position of the lowermost portion of the first intermediate member 60 (i.e., a position at which the second through-hole 64 overlaps the blocking portion 73 of the second intermediate member 70, which will be described below, as viewed in the front-rear direction).

Figure 10:
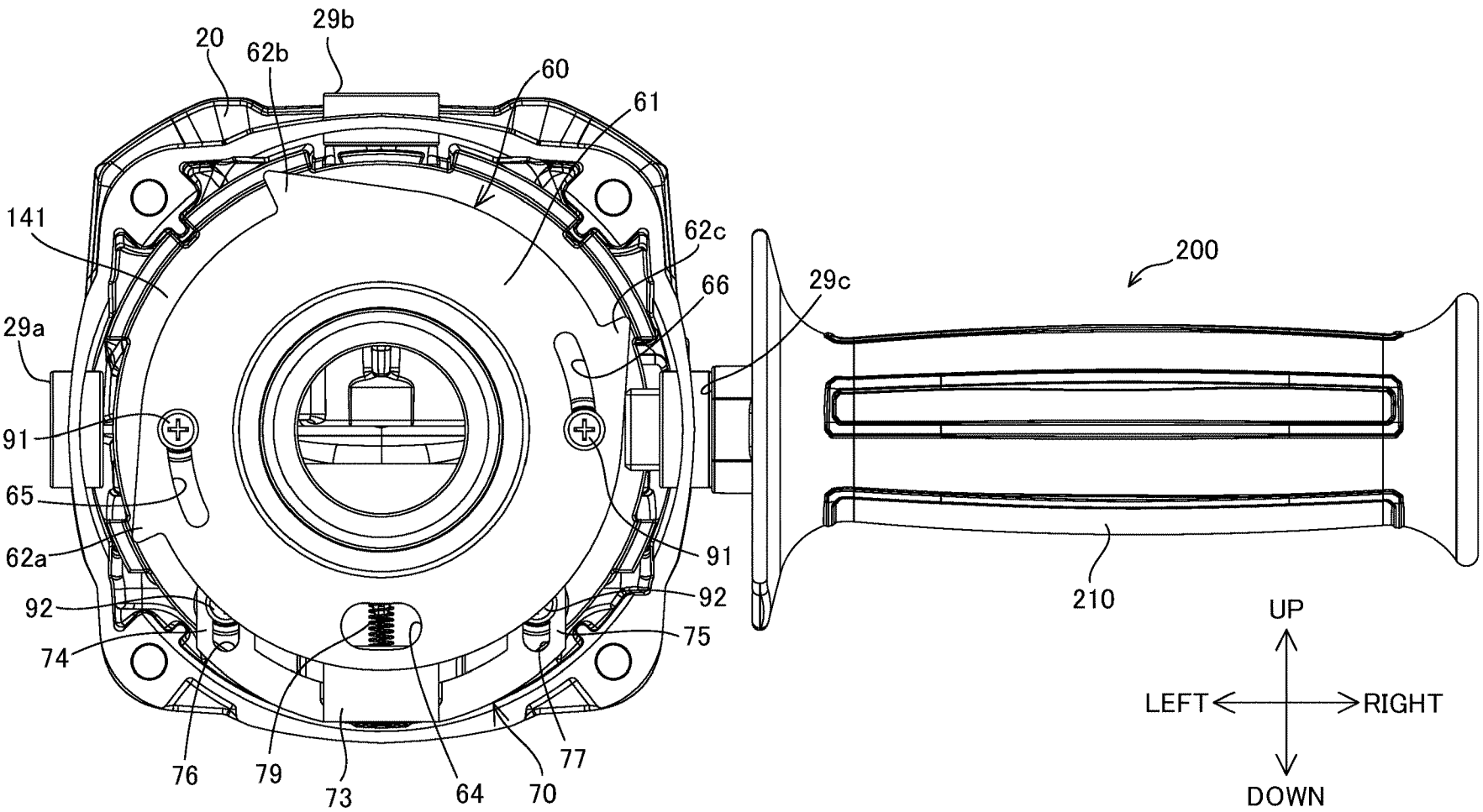
FIG. 10 illustrates the internal structure of the grinder and illustrates a state in which the side grip is attached thereto and the wheel cover is detached therefrom.
Figure 11:
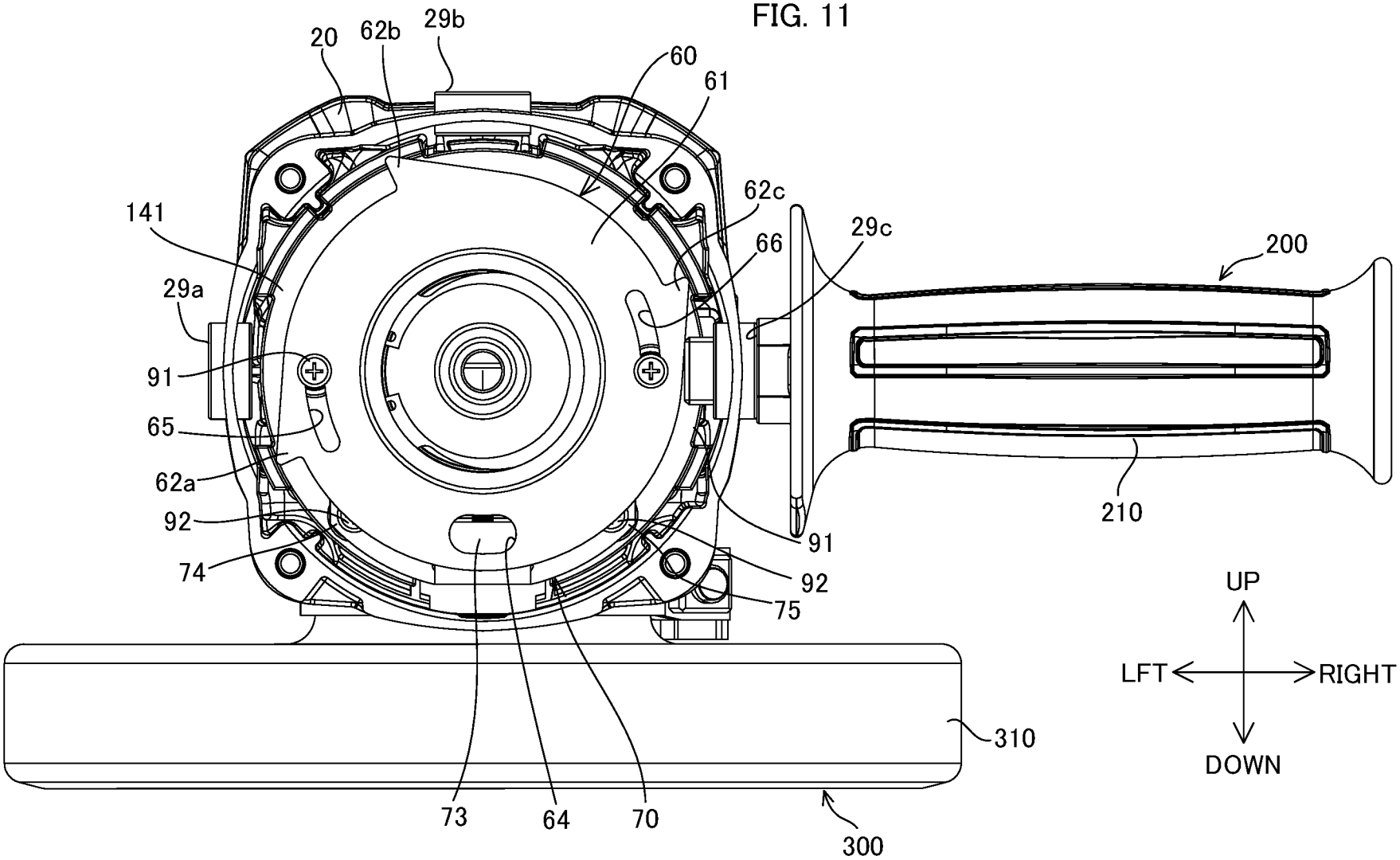
FIG. 11 illustrates the internal structure of the grinder and illustrates the state in which the side grip and the wheel cover are attached thereto.

As illustrated in FIG. 5, the first intermediate member main body 61 includes first through-holes 65 and 66. Each of the first through-holes 65 and 66 has a circular-arc shape centered at the rotational axis AX1. The first through-holes 65 and 66 are disposed at positions rotational symmetric by 180 degrees with respect to the rotational axis AX1. The first intermediate member 60 is attached to the holding member 140 using screws via these first through-holes 65 and 66. More specifically, bolts 91 are inserted in the first through-holes 65 and 66 as illustrated in FIGS. 9 to 11. These bolts 91 are threadedly engaged with screw holes 143*a* and 144*a* of the holding member 140, which will be described below. Actually, a sensor board holding member 85 (refer to FIG. 8), which will be described below, is disposed between the first intermediate member 60 and the heads of the bolts 91, and the bolts 91 are disposed so as to extend through through-holes 87 and 88 of the sensor board holding member 85 and the first through-holes 65 and 66, respectively, although this is not illustrated in FIGS. 9 to 11. Due to a predetermined clearance secured between the holding member 140 and/or the sensor board holding member 85 and the first intermediate member 60, the first intermediate member 60 is held by the holding member 140 rotatably along the circular-arc shapes of the first through-holes 65 and 66. According to this configuration, the first intermediate member 60 can be held with a simple structure.

The first intermediate member 60 further includes a protrusion 67. The protrusion 67 extends forward from the front surface of the first intermediate member main body 61. This protrusion 67 is used to bias the first intermediate member 60 toward the first non-attachment position (refer to FIGS. 4 and 9) by a spring 68 (refer to FIG. 7), which will be described below.

Figure 6:
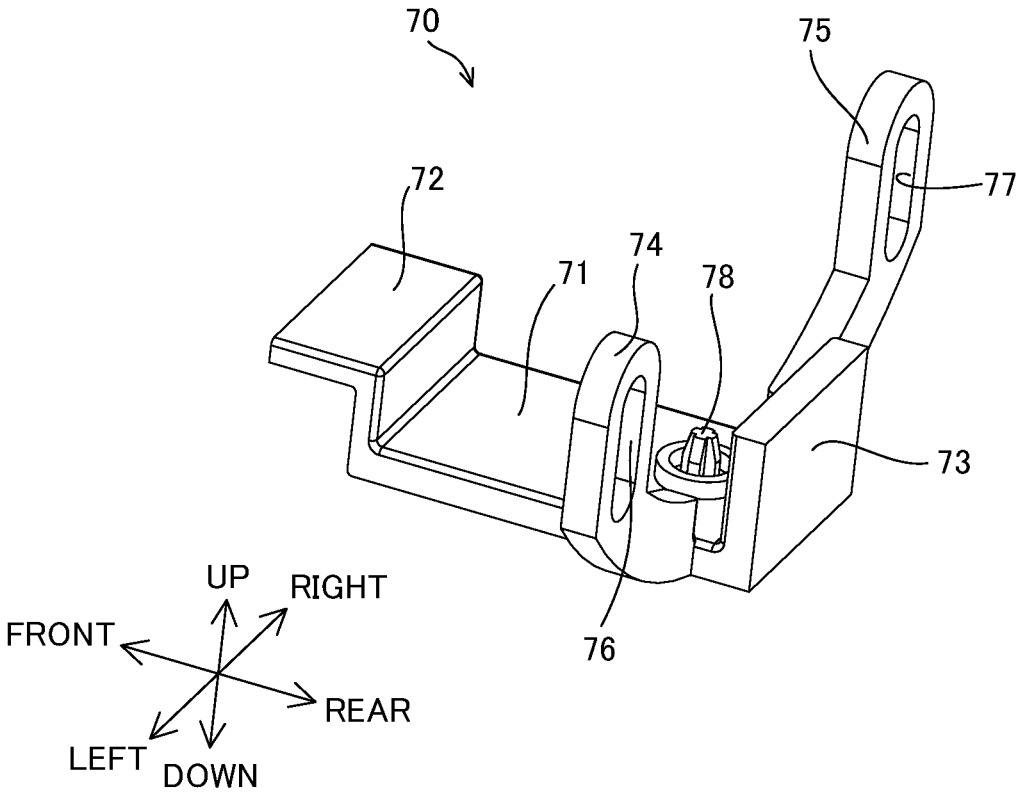
FIG. 6 is a perspective view of a second intermediate member.

Next, the second intermediate member 70 will be described. As illustrated in FIG. 6, the second intermediate member 70 includes a base 71, a pressed portion 72, a blocking portion 73, support portions 74 and 75, and a spring seat 78. The base 71 is a portion shaped like a flat plate which has a longitudinal direction extending along the front-rear direction and lies perpendicularly to the vertical direction. The pressed portion 72 is a portion pressed upward by the attachment portion 320 of the cover 300 when the cover 300 is attached to the second attachment portion 22, and is located at the front edge of the second intermediate member 70. The pressed portion 72 is shaped like a flat plate lying in parallel with the base 71. A stepped portion is formed between the base 71 and the pressed portion 72. The displacement amount of the second intermediate member 70 when the cover 300 is attached can be reduced due to this stepped portion. More specifically, when the cover 300 is attached, the second intermediate member 70 is not displaced since the attachment portion 320 of the cover 300 is in a state of being raised to the same position as the base 71 until the attachment portion 320 is brought into a state of abutting against the pressed portion 72, and therefore the displacement amount of the second intermediate member 70 is reduced by an amount corresponding the step compared to a configuration in which the pressed portion 72 is located at the same vertical position as the base 71. This can lead to a reduction in a space for the displacement of the second intermediate member 70. In other words, this can cut down an increase in the vertical size of the grinder 10.

The blocking portion 73 is a portion that blocks light emitted from the sensor 80 when the second intermediate member 70 is located at the second attachment position. The blocking portion 73 is located at the rear edge of the second intermediate member 70, and extends upward from the rear edge of the base 71. The blocking portion 73 is shaped like a flat plate extending perpendicularly to the front-rear direction.

The support portions 74 and 75 are disposed opposite from each other in the left-right direction on the front side with respect to the blocking portion 73 near the blocking portion 73. The support portions 74 and 75 have generally L-like shapes extending from the base 71 in directions away from each other in the left-right direction, and then bent and extending upward after that. Third through-holes 76 and 77 are formed on the support portions 74 and 75, respectively. The third through-holes 76 and 77 extend through the support portions 74 and 75 in the front-rear direction, respectively. The third through-holes 76 and 77 are each in the form of an elongated hole having a longitudinal direction extending along the vertical direction (i.e., a direction in which the second intermediate member 70 is linearly moved when being pressed by the cover 300). The second intermediate member 70 is attached to the holding member 140 using screws via these third through-holes 76 and 77. More specifically, bolts 92 are inserted in the third through-holes 76 and 77 as illustrated in FIGS. 9 to 11. These bolts 92 are threadedly engaged with screw holes 145*a* and 146*a* of the holding member 140, which will be described below. Due to predetermined clearances secured between the heads of the bolts 92 and the support portions 74 and 75, respectively, the second intermediate member 70 is held by the holding member 140 linearly movably along the third through-holes 76 and 77. According to this configuration, the second intermediate member 70 can be held with a simple structure.

The spring seat 78 is provided so as to protrude upward from the base 71. A spring 79 (refer to FIG. 4) is held between the spring seat 78 and a spring seat 148 of the holding member 140 (refer to FIG. 7). The spring 79 biases the second intermediate member 70 toward the second non-attachment position (refer to FIGS. 4, 9, and 10).

Figure 7:
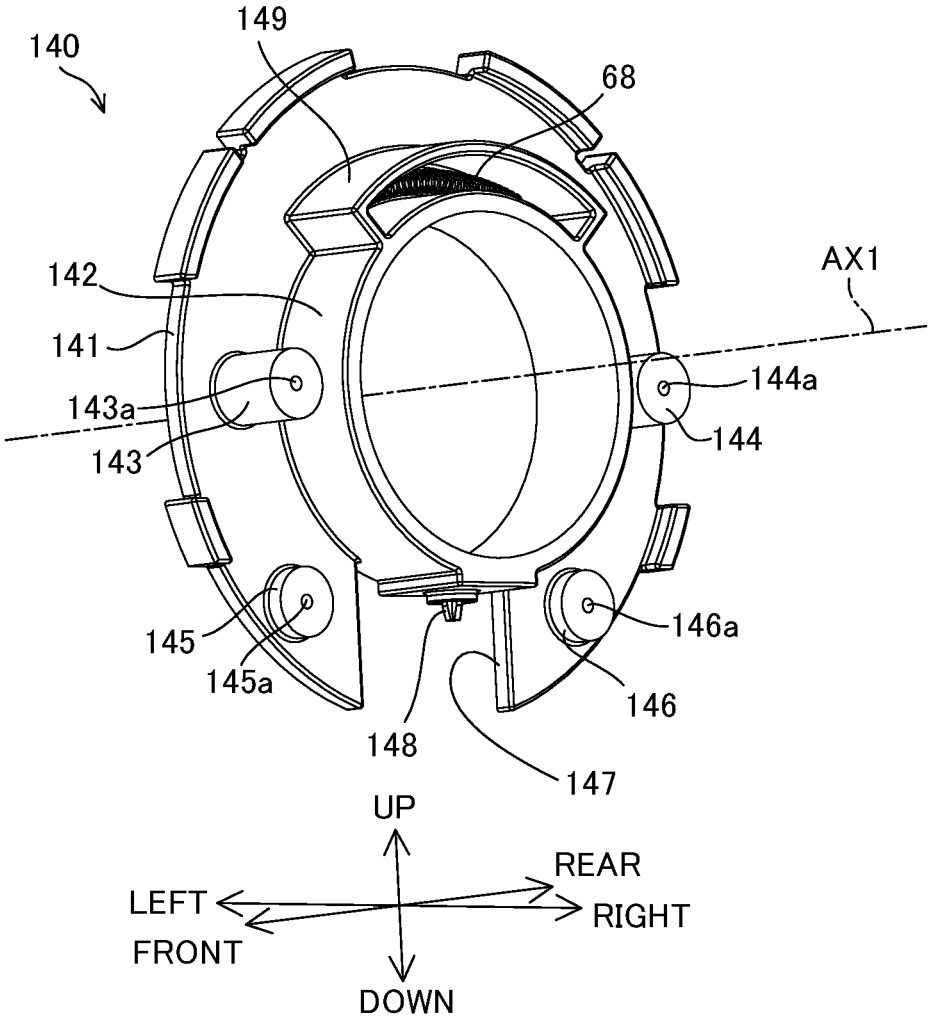
FIG. 7 is a perspective view of a holding member that holds the first intermediate member and the second intermediate member.

Next, the holding member 140 will be described. As illustrated in FIG. 7, the holding member 140 includes an annular portion 141, a hollow circular cylindrical portion 142, protrusion portions 143 and 144, protrusion portions 145 and 146, the spring seat 148, and a spring housing portion 149. The annular portion 141 has a disk-like shape centered at the rotational axis AX1 of the electric motor 31, and a through-hole is formed at the center thereof. A cutout 147 is formed on the lower side of the annular portion 141 to secure the space for the displacement of the second intermediate member 70.

The hollow circular cylindrical portion 142 has a hollow circular cylindrical shape extending rearward from the annular portion 141. The diameter of the hollow circular cylindrical portion 142 is smaller than the diameter of the annular portion 141. The spring housing portion 149 is formed at the upper side of the hollow circular cylindrical portion 142 adjacently to the hollow circular cylindrical portion 142. The spring housing portion 149 is formed to have a circular-arc shape centered at the rotational axis AX1. The spring 68 is housed in the spring housing portion 149. The spring 68 is extensible and compressible along the circular-arc shape of the spring housing portion 149. The rear side of the spring housing portion 149 is opened, and the protrusion 67 of the first intermediate member 60 is inserted in the spring housing portion 149 via this opening. One end of the spring 68 is supported on the inner surface of the spring housing portion 149 (a flat surface located at one end portion of the circular-arc shape), and the other end of the spring 68 is engaged with the protrusion 67. Due to this configuration, the first intermediate member 60 is biased in the clockwise direction (i.e., toward the first non-attachment position).

The protrusion portions 143 and 144 are disposed so as to be spaced apart from each other in the left-right direction. The protrusion portions 143 and 144 extend rearward from the annular portion 141 at approximately vertically central positions of the annular portion 141. The protrusion portions 143 and 144 include the screw holes 143*a* and 144*a* having female screws formed thereon, respectively. The screw holes 143*a* and 144*a* extend forward from the rear end surfaces of the protrusion portions 143 and 144, respectively. The bolts 91 are threadedly engaged with the screw holes 143*a* and 144*a* to mount the first intermediate member 60 to the holding member 140 in the above-described manner (refer to FIG. 9).

The protrusion portions 145 and 146 are disposed so as to be spaced apart from each other in the left-right direction on the lower side with respect to the protrusion portions 143 and 144. The protrusion portions 145 and 146 include the screw holes 145*a* and 146*a* having female screws formed thereon, respectively. The screw holes 145*a* and 146*a* extend forward from the rear end surfaces of the protrusion portions 145 and 146, respectively. The bolts 92 are threadedly engaged with the screw holes 145*a* and 146*a* to mount the second intermediate member 70 to the holding member 140 in the above-described manner (refer to FIG. 9). The lengths of the protrusion portions 145 and 146 in the front-rear direction are shorter than the lengths of the protrusion portions 143 and 144 in the front-rear direction to allow the second intermediate member 70 to be held on the front side with respect to the first intermediate member 60.

The above-described spring seat 148 is formed at the lower edge of the hollow circular cylindrical portion 142. This holding member 140 is fitted in the gear housing 20 so as to bring the outer periphery of the annular portion 141 and the inner periphery of the hollow circular cylindrical portion 142 into abutment with the gear housing 20 in a state that the first intermediate member 60 and the second intermediate member 70 are mounted thereto. As a result, the holding member 140 is fixed to the gear housing 20. Mounting the first intermediate member 60 and the second intermediate member 70 to the single holding member 140 automatically determines the relative positions of the first intermediate member 60 and the second intermediate member 70, and therefore the relative positions of the first intermediate member 60 and the second intermediate member 70 do not have to be adjusted when the grinder 10 is assembled. In addition, as described above, the holding member 140 holds the sensor board holding member 85 holding the sensor 80, and the first intermediate member 60 together. Therefore, mounting the sensor board holding member 85 also automatically determines the relative position of the sensor 80 to the first intermediate member 60 and the second intermediate member 70, and therefore the position of the sensor 80 neither has to be adjusted.

Figure 4:
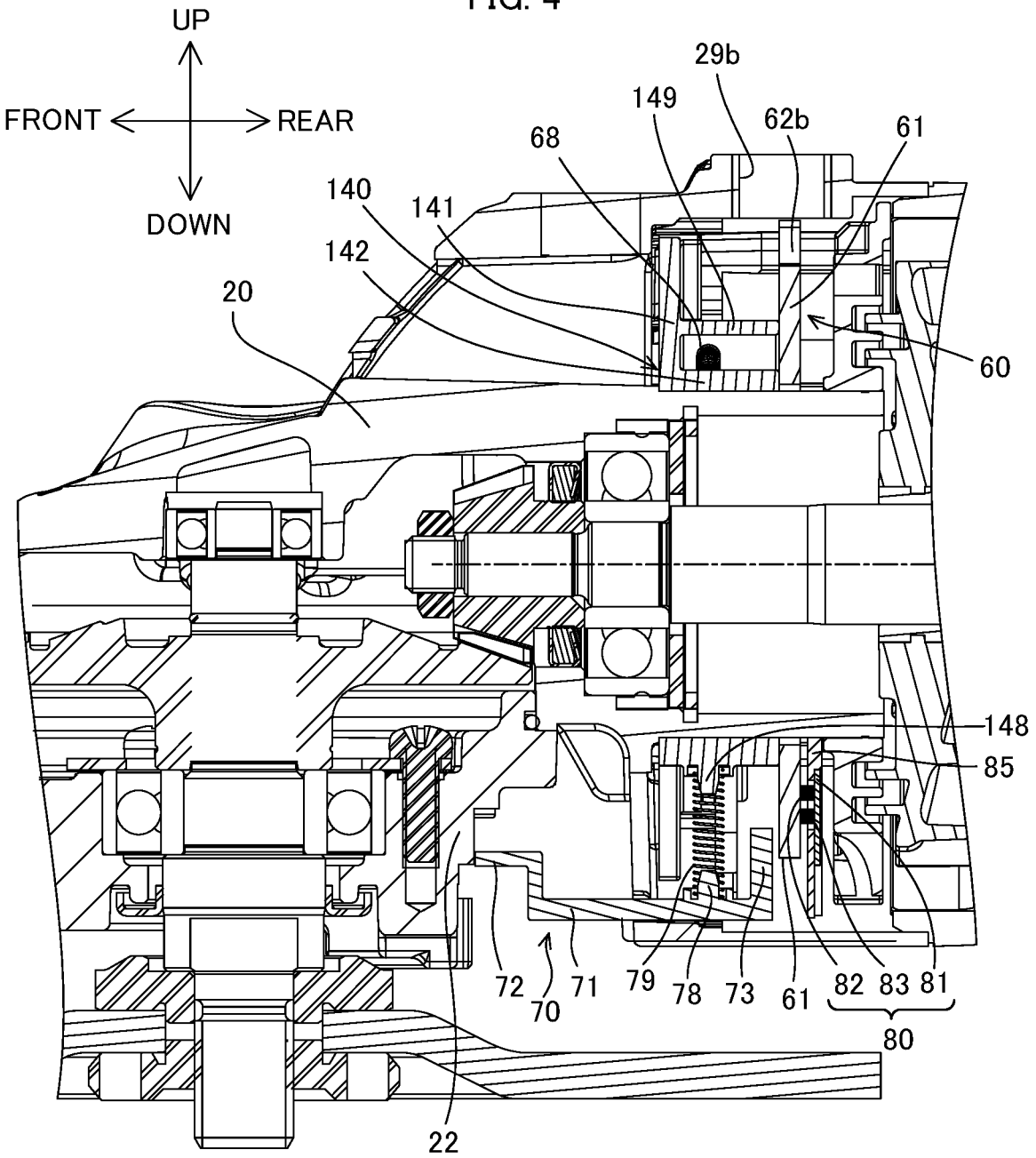
FIG. 4 is a partial enlarged view of the grinder illustrated in FIG. 2.

Next, the sensor 80 will be described. The sensor 80 is a reflection-type photosensor in the present embodiment. As illustrated in FIG. 4, the sensor 80 includes a light emitter 82, a light receiver 83, and a sensor board 81 on which the light emitter 82 and the light receiver 83 are mounted together. The light emitter 82 and the light receiver 83 are disposed on the front surface of the sensor board 81. The sensor 80 is disposed near the bottom portion of the gear housing 20 to detect the displacements of the first intermediate member 60 and the second intermediate member 70. More specifically, the sensor board 81 and the light emitter 82 are disposed behind the first intermediate member main body 61 in proximity to the first intermediate member main body 61.

Figure 8:
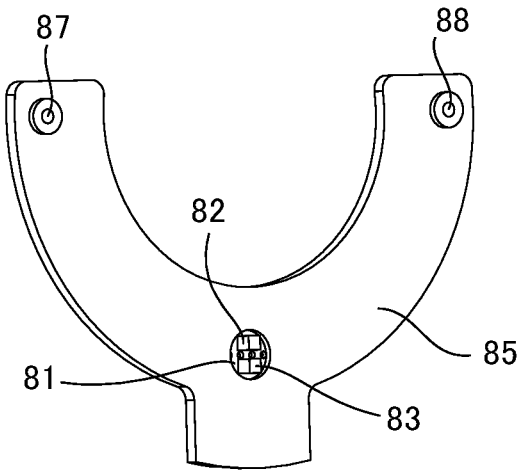
FIG. 8 is a perspective view of a sensor fixation member.

This sensor 80 is held by the sensor board holding member 85 illustrated in FIG. 8. The sensor board holding member 85 is a generally Y-shaped plate-like member. The sensor board 81, on which the light emitter 82 and the light receiver 83 are mounted, is held at a proximal portion from which the sensor board holding member 85 is forked. The sensor board 81 is fixed to the sensor board holding member 85 by any method (for example, screwing, snap-fit, or engagement using a partial heated deformation). Further, the through-holes 87 and 88 are formed near the forked distal ends of the sensor board holding member 85, respectively.

The first intermediate member 60 is displaced between a position of blocking light emitted from the light emitter 82 and a position of not blocking this light due to the attachment of the side handle 200. Similarly, the second intermediate member 70 is displaced between a position of blocking the light emitted from the light emitter 82 and a position of not blocking this light due to the attachment of the cover 300. The sensor 80 detects the state in which the side handle 200 and the cover 300 are attached, based on whether or not the light receiver 83 receives the light based on these differences in the positions of the first intermediate member 60 and the second intermediate member 70. In the following description, this will be described more specifically.

Figure 12:
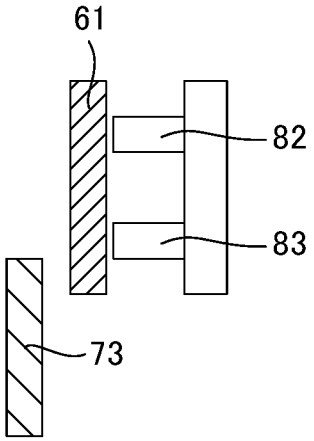
FIG. 12 is a schematic view illustrating the positional relationship between a sensor, the first intermediate member 60, and the second intermediate member 70 in the state that the side grip and the wheel cover are detached.

FIG. 12 schematically illustrates the positional relationship between the first intermediate member 60 and the second intermediate member 70 (refer to FIGS. 4 and 9), and the sensor 80 when neither of the side handle 200 and the cover 300 is attached. In the state that neither of the side handle 200 and the cover 300 is attached, the first intermediate member 60 is located at the position where the first intermediate member main body 61 blocks the light emitted from the light emitter 82 as illustrated in FIG. 12. Since the first intermediate member main body 61 is disposed in proximity to the light emitter 82 and the light receiver 83, the light receiver 83 cannot receive the light emitted from the light emitter 82. In the state that only the cover 300 of the side handle 200 and the cover 300 is attached, the first intermediate member main body 61 is also located at the position illustrated in FIG. 12 and therefore the light receiver 83 can neither receive the light emitted from the light emitter 82, although this is not illustrated.

Figure 3:
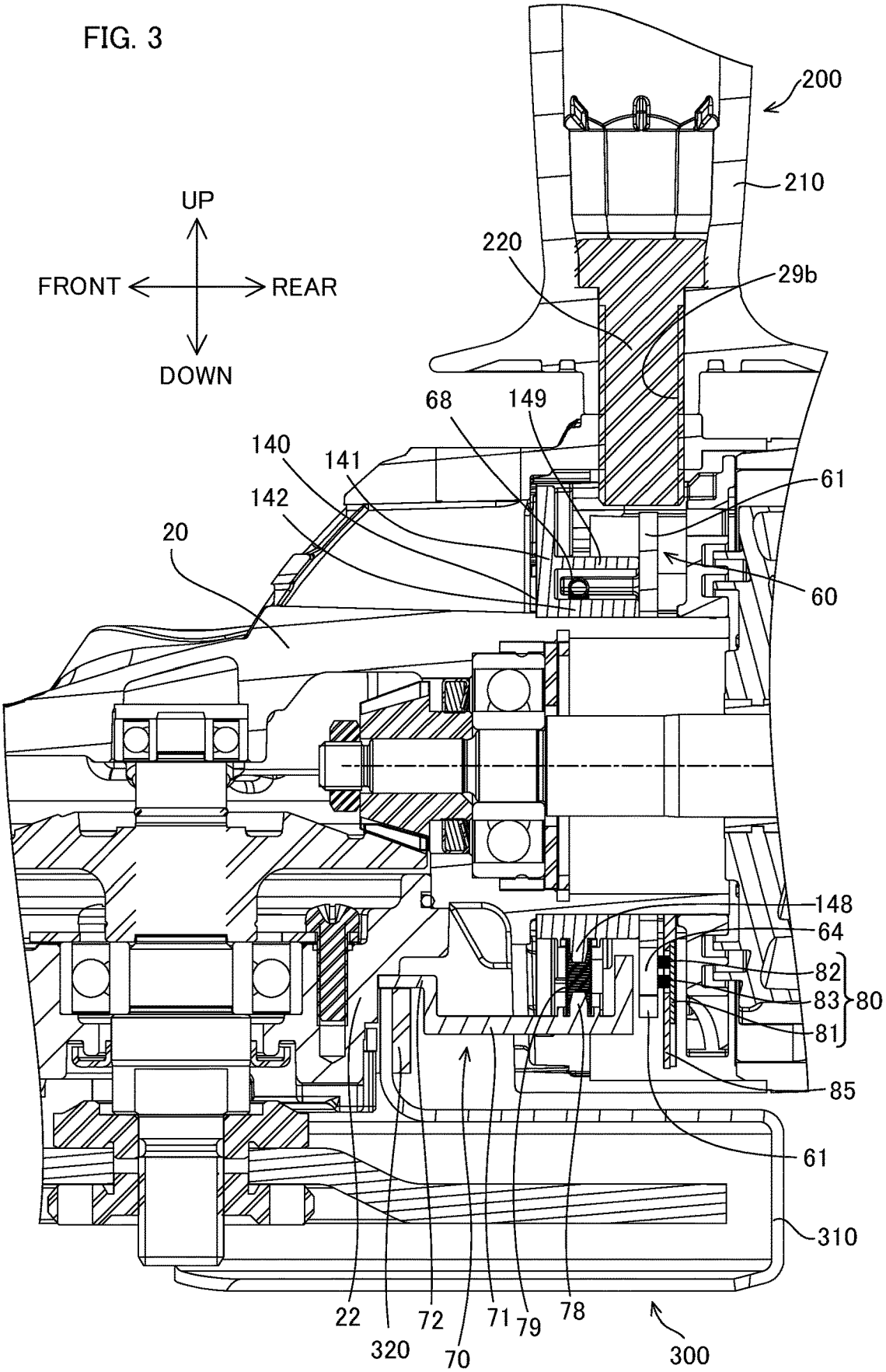
FIG. 3 is a partial enlarged view of the grinder illustrated in FIG. 1.
Figure 13:
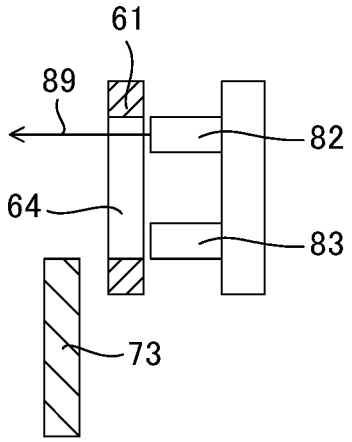
FIG. 13 is a schematic view illustrating the positional relationship between the sensor, the first intermediate member 60, and the second intermediate member 70 in the state that the side grip is attached and the wheel cover is detached.

When only the side handle 200 is attached in the state illustrated in FIG. 12, the first intermediate member 60 is displaced to the first attachment position illustrated in FIGS. 3 and 10. At this time, light 89 emitted from the light emitter 82 passes through the second through-hole 64 and therefore is not blocked by the first intermediate member main body 61, as illustrated in FIG. 13. Further, at this time, the blocking portion 73 of the second intermediate member 70 is located at the position of not blocking the light 89, and therefore the light receiver 83 cannot receive the light emitted from the light emitter 82.

Figure 14:
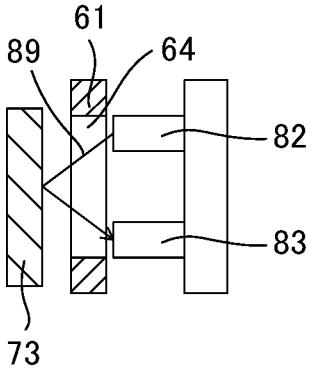
FIG. 14 is a schematic view illustrating the positional relationship between the sensor, the first intermediate member 60, and the second intermediate member 70 in the state that the side grip and the wheel cover are attached.

When the cover 300 is attached in the state illustrated in FIG. 13, the second intermediate member 70 is displaced to the second attachment position illustrated in FIGS. 3 and 11. At this time, the light 89 emitted from the light emitter 82 is blocked by the blocking portion 73 after passing through the second through-hole 64, as illustrated in FIG. 14. As a result, the light 89 is reflected by the blocking portion 73 and is received by the light receiver 83.

In this manner, according to the above-described grinder 10, the light 89 emitted from the light emitter 82 can be received by the light receiver 83 on the single sensor 80 only in the state that both the side handle 200 and the cover 300 are attached. In other words, the state in which both the side handle 200 and the cover 300 are attached can be detected using the single sensor 80. Therefore, the present configuration can reduce the number of components and the cost compared to a configuration in which an individual sensor is prepared for each of the side handle 200 and the cover 300.

Further, the first intermediate member 60 is configured to be rotated about the rotational axis AX1 when any of the pressed portions 62*a* to 62*c* is pressed by the side handle 200. This eliminates the necessity of securing a space for the displacement of the first intermediate member 60 in the front-rear direction, thereby allowing the grinder 10 to have a compact size in the front-rear direction.

Further, the second intermediate member 70 is pressed by the cover 300 (more specifically, the attachment portion 320) and is linearly moved in the attachment direction of the cover 300 (i.e., upward) when the cover 300 is attached. This eliminates the necessity of a direction conversion mechanism, thereby contributing to the simplification of the apparatus configuration.

Figure 15:
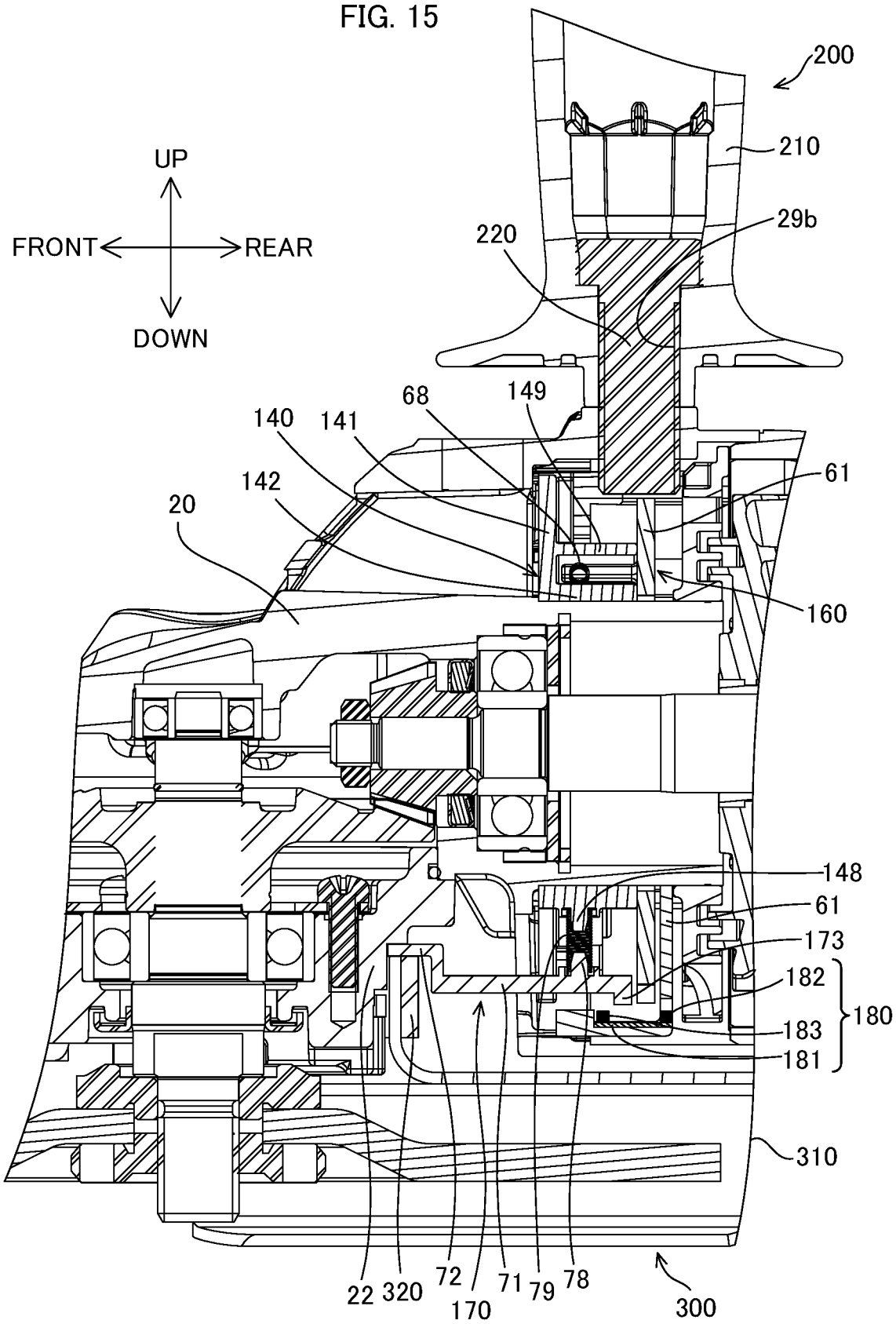
FIG. 15 is a partial vertical cross-sectional view of a grinder according to a second embodiment of the present invention, and illustrates a state in which the side grip and the wheel cover are attached thereto.
Figure 16:
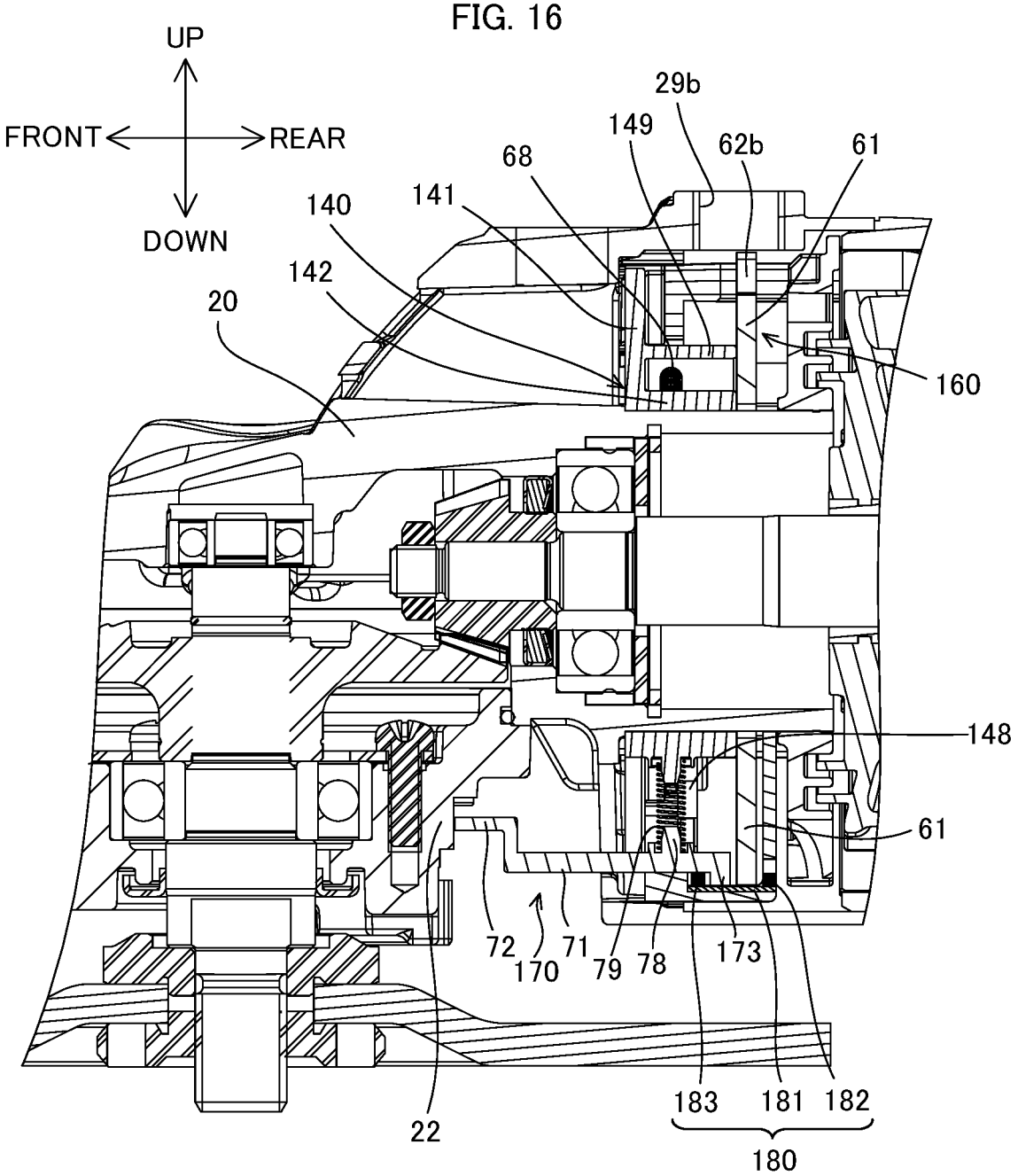
FIG. 16 is a vertical cross-sectional view of the grinder according to the second embodiment, and illustrates a state in which the side grip and the wheel cover are detached therefrom.

In the following description, a second embodiment of the present invention will be described with reference to FIGS. 15 and 16. The second embodiment is different from the first embodiment in terms of using a sensor 180 instead of the sensor 80, using a first intermediate member 160 instead of the first intermediate member 60, and using a second intermediate member 170 instead of the second intermediate member 70. In FIGS. 15 and 16, components similar to the components in the first embodiment are identified by the same reference numerals as the first embodiment. In the following description, the second embodiment will be described focusing only on differences from the first embodiment. The sensor 180 is a transmission-type photosensor in the present embodiment. As illustrated in FIGS. 15 and 16, the sensor 180 includes a light emitter 182, a light receiver 183, and a sensor board 181 on which the light emitter 182 and the light receiver 183 are mounted together. The first intermediate member 160 does not include the second through-hole 64, but instead includes a cutout on the radial outer edge portion thereof. The second intermediate member 170 includes a blocking portion 173 instead of the blocking portion 73. The blocking portion 173 extends downward from the rear edge of the base 71.

The light emitter 182 and the light receiver 183 are arranged in such a manner that the blocking portion 173 and the first intermediate member main body 61 are located between the light emitter 182 and the light receiver 183 in the front-rear direction. In this configuration, the first intermediate member main body 61 is located at a position of blocking light emitted from the light emitter 182 when the first intermediate member 160 is located at the first non-attachment position, and the blocking portion 173 is located at a position of blocking the light emitted from the light emitter 182 when the second intermediate member 170 is located at the first non-attachment position (refer to FIG. 16). In other words, when at least one of the side handle 200 and the cover 300 is not attached, the light emitted from the light emitter 182 is blocked by at least one of the first intermediate member 160 and the second intermediate member 170. Therefore, the light receiver 183 cannot receive the light emitted from the light emitter 182. On the other hand, the light emitted from the light emitter 182 can pass through the cutout of the first intermediate member 160 when the first intermediate member 160 is located at the first attachment position, and the blocking portion 173 is displaced to the position of not blocking the light emitted from the light emitter 182 when the second intermediate member 170 is located at the first attachment position (refer to FIG. 15). In other words, when both the side handle 200 and the cover 300 are attached, the light emitted from the light emitter 182 is received by the light receiver 183. Therefore, the state in which both the side handle 200 and the cover 300 are attached can be detected using the single sensor 180.

Having described the embodiments of the present invention, the above-described embodiments are intended to only facilitate the understanding of the present invention, and are not intended to limit the present invention thereto. The present invention can be modified or improved without departing from the spirit thereof, and includes equivalents thereof. Further, each of the elements described in the claims and the specification can be combined in any manner or omitted in any manner within a range that allows it to remain capable of achieving at least a part of the above-described objects or bringing about at least a part of the above-described advantageous effects.

For example, the shapes and the forms of the components of the above-described grinder 10 are merely examples, and can be changed in any manner as long as the functions of these components can be maintained. For example, the pressed portions 62*a* to 62*c* of the first intermediate member 60 may protrude forward or rearward instead of protruding radially outward. Alternatively, the first intermediate member 60 may include a blocking portion protruding radially outward from the first intermediate member main body 61 instead of the second through-hole 64. In this case, the light emitted from the light emitter 82 is blocked by the blocking portion when the first intermediate member 60 is located at the first non-attachment position, and the blocking portion is brought into a state of being displaced to the position of not blocking the light emitted from the light emitter 82 when the first intermediate member 60 is located at the first attachment position.

Further, the first intermediate member 60 may be indirectly pressed by the side handle 200 when the side handle 200 is attached. More specifically, an additional member that is displaced by being pressed by the side handle 200 may be provided, and the first intermediate member 60 may be displaced by this additional member. Similarly, the second intermediate member 70 may be indirectly pressed by the cover 300 when the cover 300 is attached.

Further, the first intermediate member 60 may be configured to be tilted by being pressed by the side handle 200 when the side handle 200 is attached instead of being configured to be rotated when the side handle 200 is attached. For example, the first intermediate member 60 may include a support shaft on the lower side of the first intermediate member 60 and be tilted about this support shaft in such a manner that the lower edge of the first intermediate member 60 approaches the front side.

Further, the second intermediate member 70 may be located at the position of blocking the light emitted from the light emitter 82 when being located at the second non-attachment position, and located at the position of not blocking the light emitted from the light emitter 82 when being located at the second attachment position. In this case, for example, a low-reflective coating material may be applied to the second intermediate member 70 in advance, and a reflection board may be disposed in such a manner that the first intermediate member 60 and the second intermediate member 70 are located between the reflection plate and the sensor 80 in the front-rear direction. Employing this layout allows the light receiver 83 to receive the light emitted from the light emitter 82 only in the state that both the side handle 200 and the cover 300 are attached.

Each of the sensors 80 and 180 is not limited to the photoelectric sensor, and may be any other known type of sensor. For example, an ultrasonic distance sensor may be employed. In this case, the state in which both the side handle 200 and the cover 300 are attached can also be detected if the first intermediate member 60 and the second intermediate member 70 are each configured to be displaced between a position of blocking an ultrasonic wave emitted from the sensor (hereinafter also referred to as a blocking position) and a position of not blocking this ultrasonic wave (hereinafter also referred to as a non-blocking position) according to whether the side handle 200 or the cover 300 is attached. For example, the first intermediate member 60 may be located at the blocking position when the side handle 200 is not attached, and be located at the non-blocking position when the side handle 200 is attached. Further, the second intermediate member 70 may be located at the blocking position when the cover 300 is not attached, and be located at the non-blocking position when the cover 300 is attached. Employing this configuration allows the sensor 80 or 180 to detect the state in which both the side handle 200 and the cover 300 are attached based on a difference in the detected distance. Alternatively, an eddy current displacement sensor may be employed. In this case, each of the first intermediate member 60 and the second intermediate member 70 is at least partially made from metal. Alternatively, a color sensor may be employed. In this case, the first intermediate member 60 and the second intermediate member 70 are colored in different colors from each other.

Further, the grinder 10 may include a notification unit for notifying the user that at least one of the side handle 200 and the cover 300 is not attached instead of or in addition to the configuration that permits or prohibits the driving of the electric motor 31 according to the attachment states of the side handle 200 and the cover 300.

The notification method may be light emission, a sound output, a character display, or a combination of them. For example, the notification unit may include at least one of a light-emitting element such as an LED, a GUI screen, and a speaker.

Further, the above-described embodiments can be applied to not only the grinder 10 but also any tool configured to allow two types of accessories to be detachably attached thereto.

DESCRIPTION OF NUMERALS

10 grinder
20 gear housing
22 second attachment portion

23 small bevel gear
24 large bevel gear
25 spindle
26 inner flange
27 lock nut
28 tool accessory
29*a* to 29*c* first attachment portion
30 motor housing
31 electric motor
32 motor shaft
33 controller
40 handle housing
41 switch
50 operation member
60, 160 first intermediate member
61 first intermediate member main body
62*a* to 62*c* pressed portion
63*a* to 63*c* pressed surface
64 second through-hole
65 first though-hole
67 protrusion
68 spring
70, 170 second intermediate member
71 base
72 pressed portion
73, 173 blocking portion
74 support portion
76 third through-hole
78 spring seat
79 spring
80, 180 sensor
81, 181 sensor board
82, 182 light emitter
83, 183 light receiver
85 sensor board holding member
87, 88 through-hole
89 light
91,92 bolt
140 holding member
141 annular portion
142 hollow circular cylindrical portion
143, 144, 145, 146 protrusion portion
143*a*, 144*a*, 145*a*, 146*a* screw hole
147 cutout
148 spring seat
149 spring housing portion
200 side handle
210 grip portion
220 attachment portion
300 cover
310 cover main body
320 attachment portion
AX1, AX2 rotational axis

The invention claimed is:

1. A tool comprising:

a first accessory;

a second accessory;

a first attachment portion configured to allow the first accessory to be detachably attached thereto;

a second attachment portion configured to allow the second accessory to be detachably attached thereto;

a first intermediate member configured to be displaced from a first non-attachment position to a first attachment position by the attachment of the first accessory to the first attachment portion;

a second intermediate member configured to be displaced from a second non-attachment position to a second attachment position by the attachment of the second accessory to the second attachment portion; and a single sensor configured to detect a specific state in which the first intermediate member is located at the first attachment position and the second intermediate member is located at the second attachment position.

2. The tool according to claim 1, wherein the single sensor is a photoelectric sensor including a light emitter and a light receiver, or an ultrasonic sensor, the first intermediate member is configured to be displaced between a position of blocking light emitted from the light emitter or an ultrasonic wave emitted from the ultrasonic sensor and a position of not blocking the light or the ultrasonic wave due to the attachment or no attachment of the first accessory to the first attachment portion, and the second intermediate member is configured to be displaced between a position of blocking the light or the ultrasonic wave and a position of not blocking the light or the ultrasonic wave due to the attachment or no attachment of the second accessory to the second attachment portion.

3. The tool according to claim 2, wherein the single sensor is a reflection-type photosensor.

4. The tool according to claim 2, wherein the single sensor is a transmission-type photosensor.

5. The tool according to claim 1, further comprising:

an electric motor; and a controller configured to control driving of the electric motor, wherein the controller permits the electric motor to be driven when the single sensor detects the specific state and prohibits the electric motor from being driven when the single sensor does not detect the specific state.

6. The tool according to claim 5, wherein the tool is a grinder including a tool accessory configured to be rotated by the electric motor, the first accessory is a side grip, and the second accessory is a cover that partially covers the tool accessory.

7. The tool according to claim 6, wherein the first attachment portion includes at least two side grip attachment portions for selectively attaching the side grip, the first intermediate member is a single member provided in common for the at least two side grip attachment portions and configured to be rotatable about a rotational axis of the electric motor, the at least two side grip attachment portions are located at positions spaced apart from each other in a circumferential direction around the rotational axis, respectively, and the first intermediate member includes at least one pressed portion configured to, when the side grip is attached to one side grip attachment portion arbitrarily selected from the at least two side grip attachment portions, be directly or indirectly pressed by the side grip, and the first intermediate member is rotated about the rotational axis when the at least one pressed portion is pressed.

8. The tool according to claim 7, wherein the first intermediate member includes a first intermediate member main body having an annular shape or a partially annular shape centered at the rotational axis.

9. The tool according to claim 8, wherein the at least one pressed portion protrudes radially outward from the first intermediate member main body, and the at least one pressed portion is provided at at least two positions respectively corresponding to positions of the at least two side grip attachment portions, respectively.

10. The tool according to claim 7, wherein the at least one pressed portion includes a pressed surface angled with respect to a longitudinal direction of the side grip in such a manner that the first intermediate member is displaced in a direction different from the longitudinal direction of the side grip, the longitudinal direction of the side grip being a longitudinal direction of the side grip when the side grip is attached to the one side grip attachment portion.

11. The tool according to claim 7, wherein the first intermediate member main body includes a first through-hole having a circular-arc shape centered at the rotational axis, and the first intermediate member main body is attached rotatably along the circular-arc shape using a screw via the first through-hole.

12. The tool according to claim 7, wherein the single sensor is a photoelectric sensor including a light emitter and a light receiver, or an ultrasonic sensor, the first intermediate member is configured to be displaced between a position of blocking light emitted from the light emitter or an ultrasonic wave emitted from the ultrasonic sensor and a position of not blocking the light or the ultrasonic wave due to the attachment or no attachment of the first accessory of the first attachment portion, the second intermediate member is configured to be displayed between a position of blocking the light or the ultrasonic wave and a position of not blocking the light or the ultrasonic wave due to the attachment or no attachment of the second accessory to the second attachment portion, the first intermediate member includes a through-hole, and the light or the ultrasonic wave passes through the through-hole when the first intermediate member is located at the position of not blocking the light or the ultrasonic wave.

13. The tool according to claim 6, wherein the second intermediate member is configured to be linearly moved by being directly or indirectly pressed by the cover when the cover is attached to the second attachment portion.

14. The tool according to claim 13, wherein the second intermediate member includes a through-hole in the form of an elongated hole having a longitudinal direction extending along a direction in which the second intermediate member is linearly moved, and the second intermediate member is attached linearly movably along the elongated hole using a screw via the through-hole.

15. The tool according to claim 1, further comprising a single holding member that holds the first intermediate member and the second intermediate member.

16. The tool according to claim 8, wherein the at least one pressed portion includes a pressed surface angled with respect to a longitudinal direction of the side grip in such a manner that the first intermediate member is displaced in a direction different from the longitudinal direction of the side grip, the longitudinal direction of the side grip being a longitudinal direction of the side grip when the side grip is attached to the one side grip attachment portion.

17. The tool according to claim 9, wherein the at least one pressed portion includes a pressed surface angled with respect to a longitudinal direction of the side grip in such a manner that the first intermediate member is displaced in a direction different from the longitudinal direction of the side grip, the longitudinal direction of the side grip being a longitudinal direction of the side grip when the side grip is attached to the one side grip attachment portion.

18. The tool according to claim 8, wherein the first intermediate member main body includes a first through-hole having a circular-arc shape centered at the rotational axis, and the first intermediate member main body is attached rotatably along the circular-arc shape using a screw via the first through-hole.

19. The tool according to claim 7, wherein the second intermediate member is configured to be linearly moved by being directly or indirectly pressed by the cover when the cover is attached to the second attachment portion, and the tool further comprises a single holding member that holds the first intermediate member and the second intermediate member.

* * * * *